US006209653B1

(12) United States Patent
Pringle

(10) Patent No.: US 6,209,653 B1
(45) Date of Patent: Apr. 3, 2001

(54) WELL LOCK WITH MULTIPLE SHEAR PLANES AND RELATED METHODS

(75) Inventor: Ronald E. Pringle, Houston, TX (US)

(73) Assignee: Camco International Inc., Houston, TX (US)

( * ) Notice: Subject to any disclaimer, the term of this patent is extended or adjusted under 35 U.S.C. 154(b) by 0 days.

(21) Appl. No.: 09/250,597

(22) Filed: Feb. 16, 1999

Related U.S. Application Data

(60) Provisional application No. 60/075,049, filed on Feb. 18, 1998.

(51) Int. Cl.[7] ..... E21B 23/00; E21B 43/10

(52) U.S. Cl. ..... 166/382; 166/208; 166/123; 166/181

(58) Field of Search ..... 166/381, 382, 166/208, 217, 123, 181

(56) References Cited

U.S. PATENT DOCUMENTS

| | | | | |
|---|---|---|---|---|
| 1,894,094 | | 1/1933 | Hackett | 285/3 |
| 2,946,388 | | 7/1960 | Evans | 166/120 |
| 3,186,745 | | 6/1965 | Lyles | 403/2 |
| 3,585,803 | | 6/1971 | Bardgette | 61/53 |
| 4,161,984 | * | 7/1979 | Watkins | 166/382 |
| 4,254,829 | | 3/1981 | Watkins | 166/134 |
| 4,292,819 | | 10/1981 | van der Lely et al. | 464/33 |
| 4,399,873 | | 8/1983 | Lindsey, Jr. | 166/380 |
| 4,426,105 | | 1/1984 | Plaquin et al. | 285/92 |
| 4,457,368 | | 7/1984 | Knierimen et al. | 166/217 |
| 4,459,931 | | 7/1984 | Glidden | 114/230 |
| 4,479,539 | * | 10/1984 | Tamplen et al. | 166/212 |
| 4,497,371 | | 2/1985 | Lindsey, Jr. | 166/377 |
| 4,510,995 | * | 4/1985 | Krause, Jr. et al. | 166/217 |
| 4,570,707 | | 2/1986 | Setterberg, Jr. | 166/214 |
| 4,718,488 | | 1/1988 | Pringle et al. | 166/135 |
| 4,796,698 | * | 1/1989 | Gano | 166/135 |
| 4,815,747 | | 3/1989 | Wolford | 277/1 |
| 4,823,872 | | 4/1989 | Hopmann | 166/217 |

(List continued on next page.)

FOREIGN PATENT DOCUMENTS

| | | |
|---|---|---|
| 2 172 633 | 9/1986 | (GB) . |
| 2312455 | 10/1997 | (GB) . |

OTHER PUBLICATIONS

Camco; Packers and Completion Accessories Catalog Undated.

Camco; Camco Product Line Catalogs Undated.

Camco Products & Services; Product Operating Manual DB–6 Series No–Go Locks 1990.

Camco Products & Services; Product Operating Manual DB–6 HP No–Go Locks 1990.

Camco Products & Services; Product Operating Manual M Series Selective Locks 1990.

Camco Products & Services; Product Technical Brochure; PRS Wireline Pulling Tool; 1987.

Camco Products & Services; Product Operating Manual; JD Series Wireline Pulling Tool 1991.

Camco Products & Services; Product Operating Manual; C Series No–Go Locks 1990.

Camco Products & Services; Product Operating Manual; A Series Slip Lock 1989.

(List continued on next page.)

*Primary Examiner*—David Bagnell
*Assistant Examiner*—Jennifer R. Dougherty
(74) *Attorney, Agent, or Firm*—Goldstein & Healey, L.L.P.

(57) ABSTRACT

In a broad aspect, the invention is directed to a well locking device having a shear ring for retaining a setting wedge within a well lock housing during running, setting, locking, and removing the well locking device within a bore of a well tubing. In a particular embodiment, the well locking device may include a no-go shoulder provided on the running tool used to locate and set the well lock downhole within the tubing.

10 Claims, 5 Drawing Sheets

U.S. PATENT DOCUMENTS

| | | | | |
|---|---|---|---|---|
| 4,883,121 | * | 11/1989 | Zwart | 166/217 |
| 5,311,820 | | 5/1994 | Ellingsen | 102/481 |
| 5,379,837 | | 1/1995 | Reid | 166/208 |
| 5,390,735 | | 2/1995 | Williamson, Jr | 166/115 |
| 5,404,956 | | 4/1995 | Bohlen et al. | 166/387 |
| 5,409,059 | | 4/1995 | McHardy | 166/208 |
| 5,474,126 | | 12/1995 | Lynde et al. | 166/117.6 |
| 5,526,884 | * | 6/1996 | Lembcke | 166/382 |
| 5,617,918 | * | 4/1997 | Cooksey et al. | 166/115 |

OTHER PUBLICATIONS

Camco Products & Services; Product Operating Manual; W Series Selective Landing Nipples 1989.

Camco Products & Services; Product Operating Manual; DE Series Landing Nipples 1991.

Camco Products & Services; Product Operating Manual; D–15 Landing Nipples 1989.

Camco Products & Services; Product Operating Manual; D Series Landing Nipples 1990.

* cited by examiner

WELL LOCK WITH MULTIPLE SHEAR PLANES AND RELATED METHODS

RELATED APPLICATIONS

This application claims the benefit of U. S. Provisional Application No. 60/075,049, filed Feb. 18, 1998.

BACKGROUND OF THE INVENTION

1. Field of the Invention

The present invention relates to a well locking device and double-shear shear ring, which may be used therewith.

2. Description of the Related Art

The present invention constitutes an improvement over prior well locks and in shearable retaining means that may be used in the setting and removal of those well locks.

Conventional well locks include selective locks and no-go locks. Selective locks utilize a specific type of profile in a portion of a well bore location at which the well lock is to be set. The well bore is cut to receive matching keys in the well lock for locating the well lock within a desired downhole portion of the well bore. When the well lock is lowered into the portion of the well bore having the proper profile, the well lock keys will engage within the well bore profile to engage, for example, locking dogs within a locking recess in the well bore to lock the well lock in place. Selective locks are expensive and complicated and, in operation, may have mechanical difficulties or other drawbacks.

Generally more reliable than selective locks are no-go locks, which typically incorporate a no-go landing shoulder in both the well bore and a portion of the well lock housing body, itself. When the well lock is lowered into the well bore, the no-go shoulder on the well lock housing abuts the no-go shoulder in the well bore preventing further downhole movement of the well lock body. The well lock is thereby positioned in the desired locking position for engaging the locking dogs, for example, within corresponding locking recesses of the well bore to engage the well lock in the desired downhole position of the well bore. However, when the no-go landing profile is provided on the well lock housing body, downward pressure against the well lock may be borne by the no-go landing shoulder and the well lock body housing, not by the locking dogs of the well lock, which may be stronger than the well lock housing. Providing the no-go shoulder on the well lock housing may, therefore, create undesirable high bearing stresses on a portion of the well lock housing or may have additional drawbacks. A shearable no-go shoulder has been used so that, once the well lock is positioned in the well bore and the locking dogs engaged, the shearable no-go shoulder on the well lock body can be sheared by additional downward force to relieve operating stresses from the well lock body, which may be advantageously borne by the locking dogs. Similarly, retractable no-gos have been provided that retract from engagement of the no-go in the well bore upon setting of the locking dogs. However, use of such complicated retractable and shearable no-go shoulders could be expensive, may prevent complications upon removal of the well lock from the well bore, and may otherwise be undesirable in certain applications. Accordingly, removing the no-go landing shoulder from the well lock housing body may be desirable in certain applications.

No-go locks are typically operated in multiple modes. For example, in a running mode, the locking dogs of the well lock are withdrawn within the well lock housing to allow the well lock to run freely within the well bore. In a locking mode, the locking dogs may be engaged within a recess in the well bore by use of a setting wedge associated with the well lock to force the locking dogs into the recess of the well bore, thereby setting the well lock and locking it in place within the desired downhole portion of the well bore. Thereafter, in a pulling mode, the locking dogs may be disengaged from within the recesses of the well bore so that the well lock can be removed from the well bore. The modes of operation may typically be provided by use of multiple shear pins provided in connection with: the well lock housing and running tool that is used to position and set the well lock within the well bore; the setting wedge that is used to set the well lock within the well bore and a first location on the well lock housing; and the setting wedge and a second location on the well lock housing.

In operation of a typical well lock having multiple shear pins, a first shear pin may be provided on the running tool to initially attach the running tool to the lock housing to permit lowering of the well lock within the well bore by use of the running tool; a second shear pin may be provided in a first location on the well lock housing to prevent the setting wedge from engaging the locking dogs and thereby setting the well lock prior to proper positioning; and a third shear pin may then be provided at a second location on the well lock housing to lock the setting wedge in place within the well lock housing when the locking dogs are engaged to maintain the locking of the well lock within the well bore. However, use of multiple shear pins may provide unnecessary complications, and may require the use of garter springs and other elements that could be prone to failure. Accordingly, use of multiple shear pins may be unreliable in certain applications.

The present invention may overcome one or more of any shortcomings that may be present in the prior systems.

SUMMARY OF THE INVENTION

The present invention has been contemplated to overcome the foregoing deficiencies and meet the above described needs. In a broad aspect, the invention is an improved well locking device for locking in the bore of a tubing in a well using a running tool, the tubing including a recess for receiving a portion of at least one locking dog associated with the well locking device and also including a no-go shoulder adapted to receive a no-go shoulder associated with the well locking device, wherein the improvement includes locating the no-go shoulder associated with the well locking device on the running tool.

In another aspect of the invention, the invention is a well locking device for locking in the bore of a tubing in a well, the tubing having a no-go shoulder and a recess formed therein. The well locking device may comprise: a well lock, having at least one locking dog adapted for releasable engagement within the recess of the tubing; and a setting tool, releasably engageable in connection with the well lock for placement and removal of the well lock within the bore of the tubing, the setting tool having a no-go shoulder located thereon for engagement with the no-go shoulder of the tubing.

In yet another aspect of the invention, the invention is a well lock for locking in the bore of a tubing in a well comprising: a well lock housing having a plurality of recesses formed therein; a setting wedge having a recess formed therein; and a shear ring disposed in the setting wedge recess for selectively providing engagement of the setting wedge within the plurality of recesses formed in the well lock housing. The shear ring may be a double-shear shear ring. In this aspect of the invention, the well lock may further include at least one locking dog disposed in connection with the well lock housing and adapted for releasable engagement within a recess in the tubing, and the plurality of recesses may includes a first and a second recess, the setting wedge may be slidably disposed within the well lock housing, and the shear ring may include a spring portion disposed within the recess of the setting wedge and a shearing portion comprising a first and second shearable segment extending outwardly from the recess of the setting wedge for initial engagement of the first shearable segment within the first recess of the well lock housing and for subsequent engagement of the second shearable segment within the second recess of the well lock housing.

In another aspect of the invention, the invention is a well lock for locking in the bore of a tubing in a well comprising: a well lock housing having a first and second recess formed therein; at least one locking dog disposed in connection with the well lock housing and adapted for releasable engagement within a recess in the tubing; a setting wedge slidably disposed within the well lock housing, and having a recess formed therein; and a double-shear shear ring having a spring portion of the double-shear shear ring disposed within the recess of the setting wedge and having a shearing portion comprising a first and second shearable segment extending outwardly from the recess of the setting wedge for initial engagement of the first shearable segment within the first recess of the well lock housing and for subsequent engagement of the second shearable segment within the second recess of the well lock housing. The setting wedge may be selectively moveable between: a first position, in which the setting wedge permits the at least one locking dog to be disengaged from the recess of the tubing and in which the double-shear shear ring is outwardly biased so that the first shearable segment of the shearing portion is engaged within the first recess of the well lock housing; and a second position wherein the setting wedge permits the at least one locking dog to be engaged within the recess of the tubing and in which the double-shear shear ring is outwardly biased so that the second shearable segment of the shearing portion is engaged within the second recess of the lock housing. Moreover, the first shearable segment of the shearing portion may be shearable upon a first setting force being applied to the setting wedge and wherein the second shearable segment of the shearing portion is shearable upon a second setting force being applied to the setting wedge. In addition, the first setting force is a downward force and the second setting force is an upward force.

In still another aspect of the invention, the invention is a shear ring, comprising: a shearing portion comprising at least one shear plane; and a spring portion biased against the shearing portion. The spring portion may be fused to the shearing portion at a fuse location; the fuse location may be a shear plane; or the shearing portion may include a plurality of shear planes.

In another aspect of the invention, the invention may be a method of setting and removing a well lock, the well lock having a setting wedge, a well lock housing, and a shear ring disposed in a recess of the setting wedge and adapted for selective engagement of the setting wedge within at least first and second recesses formed in the well lock housing, the shear ring initially engaged within the first recess of the well lock housing, including the steps of: providing a running tool; lowering the well lock into a downhole portion of a well tubing bore in which the well lock is to be set; providing a first shearing force against the setting wedge to shear the shear ring along a first shear plane, to set the well lock in the tubing, and to engage the shear ring within the second recess of the well lock housing; and providing a second shearing force against the setting wedge to shear the shear ring along a second shear plane and to remove the well lock from the tubing. The method may further include providing a bearing means for preventing downward movement of the well lock beyond the downhole portion of the well tubing bore in which the well lock is to be set. The bearing means may include a nipple landing shoulder formed in the tubing; and the bearing means may further include a no-go shoulder formed in the running tool.

In another aspect of the invention, the invention may be a method of setting and removing a well lock in a bore of a tubing having a recess formed therein, the well lock having a well lock housing with a first and a second recess, at least one locking dog, a setting wedge initially disposed at a first position within the well lock housing, the setting wedge having a recess formed therein, an outwardly biased spring portion of a shear ring disposed within the setting wedge recess, and a first shearable segment of a shearing portion of the shear ring initially engaged within the first recess of the well lock housing, the method comprising: providing a running support tool adapted to be detachably connected to the well lock housing; detachably connecting the running support tool to the well lock housing; lowering the running support tool with the well lock connected thereto into a downhole portion of a well tubing bore in which the well lock is to be set; providing a running setting tool adapted to engage the setting wedge upon application of a downward force against the setting wedge; lowering the running setting tool until it engages the setting wedge; providing a downward force against the running setting tool sufficient to shear the first shearable segment of the shearing portion of the shear ring and to lower the setting wedge to a second position within the well lock housing, wherein the outwardly biased spring portion of the shear ring causes a second shearable segment of the shearing portion of the shear ring to be engaged within the second recess of the well lock housing and wherein the setting wedge causes the at least one locking dog to be engaged within the tubing recess; detaching the running support tool from the well lock housing and removing the running support tool from the downhole portion of the well tubing bore; providing a running removal tool adapted to engage the setting wedge of the well lock; lowering the running removal tool into the downhole portion of the well tubing bore until it engages the setting wedge; and providing an upward force against the running removal tool sufficient to shear the second shearable segment of the shearing portion of the shear ring, to raise the setting wedge from the second position within the well lock housing to the first position within the well lock housing to permit the at least one locking dog to be disengaged from the tubing recess, and to remove the well lock from the downhole portion of the tubing bore. The method may further include providing a bearing means for preventing downward movement of the well lock beyond the downhole portion of the well tubing bore in which the well lock is to be set. The bearing means may include a nipple landing shoulder provided formed in the tubing; and the bearing means may further include a no-go shoulder formed in the running support tool.

In yet another aspect, the present invention may be a method of setting a well lock, comprising: providing a nipple landing shoulder on a tubing proximally above at least one recess in the tubing; connecting a well lock to a running tool having a no go shoulder; running the running tool and the well lock into the tubing; positioning the no go shoulder into landing abutment with the nipple landing shoulder; shearing a shear ring of the well lock allowing a setting wedge of the well lock to move relative to the well lock housing of the well lock from a running position to a locking position; and forcing at least one locking dog into the at least one recess when the setting wedge is in the locking position. The method may further include: shearing the shear ring of the well lock allowing the setting wedge to move relative to the well lock housing from the locking position to a removal position; and releasing the at least one locking dog from the at least one recess when the setting wedge is in the removal position.

Figure 1:
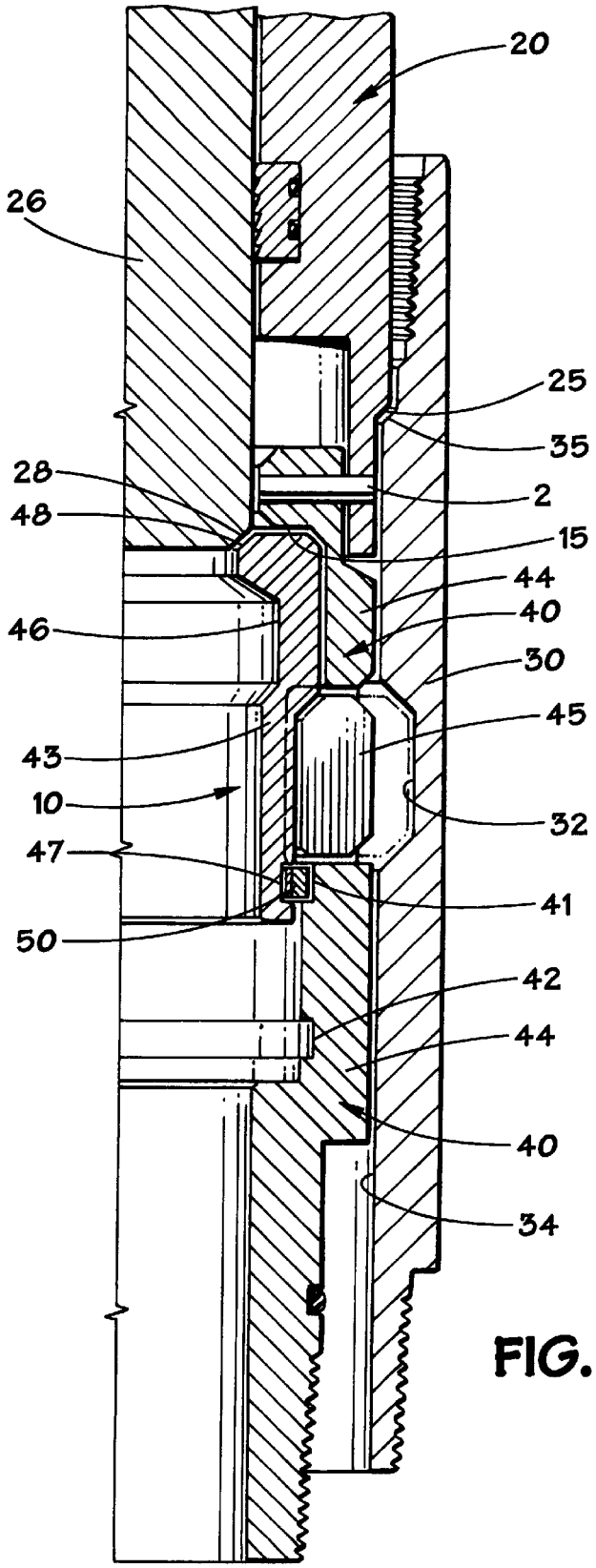
FIG. 1 is a partial elevational view, partly in cross section, illustrating the well lock of the present invention in a running position in a landing nipple prior to locking.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Referring to the drawings in detail, wherein like numerals denote like elements throughout the several views, it can be seen, with reference to FIGS. 1–6, that in a specific embodiment of the apparatus of the present invention, a well locking device 10 is provided that may lack a no-go shoulder on the well lock body and may, instead, include a no-go shoulder 25 located on a running tool 20, which may be used to locate and set a well lock 40. The well locking device 10 may further include a shear ring 50 having multiple shear planes to lock the well lock 40 in each of several modes of operation.

Referring now to FIG. 1, the well locking device 10 of the present invention is shown in a running mode, being lowered into a desired downhole position within a bore 34 of a tubing 30 provided within a well (not shown). The running tool 20 is shown having a shearable shear pin 2 or other retaining means connecting the running tool 20 to a housing 44 of the well lock 40. Use of the shearable shear pin 2 initially permits the well lock 40 to be lowered into the well bore 34 of the tubing 30 by lowering the running tool 20 attached thereto. The well lock 40 is lowered into the bore 34 of the tubing 30 until the no-go shoulder 25 of the running tool 20 abuts a nipple landing shoulder 35 on the tubing 30. The no-go shoulder 25 and the nipple landing shoulder 35 provided in connection with the well locking device 10 and tubing 30, respectively, comprise a bearing structure, which prevents downhole movement of the well lock 40 when the well lock 40 has reached the proper location within the tubing 30 for engagement thereof. However, it should be readily apparent to one of ordinary skill in the art that the no-go shoulder 25 and the nipple landing shoulder 35 can be placed in various locations in connection with the well locking device 10 and the tubing 30 and other bearing designs could be used. For example, a particular embodiment of the well locking device 10 of the present invention could incorporate a selective lock (not shown) having matching keys and recesses provided in connection therewith for proper placement of the well lock 40 within the tubing 30. Other bearing designs will also be readily recognized by those of ordinary skill in the art. In particular embodiments, such bearing designs could be used in connection with certain aspects of the device and method of the present invention. Placement of the no-go shoulder 25 on the running tool 20 and not on the well lock housing 44 may increase the structural integrity of the well lock housing 44 and may eliminate the need for shearable or retractable no-go shoulders (not shown) on the well lock housing 44, which may be provided in a particular embodiment to eliminate undesirable stresses on the well lock housing 44.

After the well lock 40 is positioned within the desired downhole portion of the tubing 30, and the well lock 40 is set, as described further hereinafter, an upward force may be applied to the running tool 20 to shear the shear pin 2, thus separating the running tool 20 from the well lock housing 44 and allowing the running tool 20 to be removed from the bore 34 of the tubing 30 after locking the well lock 40 in place. Shear pin 2 may be used to temporarily connect the running tool 20 to the well lock housing 44. However, other retaining means may be provided, such as retractable fingers (not shown) provided in connection with the running tool 20 to engage an inner groove such as a recess 46 formed within a setting wedge 43 of the well lock 40. In such an embodiment, when the running tool 20 is removed from the well lock 40, the retractable fingers (not shown) may be retracted, thus disengaging the running tool 20 from the well lock 40 and permitting removal of the running tool 20 from the bore 34 of the tubing 30.

At least a portion 28 of a setting portion 26, or setting tool 26, of the running tool 20 is provided in contact with at least a portion 48 of the setting wedge 43 of the well lock 40. After the well lock 40 is positioned within the desired downhole portion of the tubing 30, a downward pressure force may be applied to the setting portion 26, or setting tool 26, of running tool 20, which may be resisted by abutment of the no-go shoulder 25 and the nipple landing shoulder 35, provided on the running tool 20 and the tubing 30, respectively. The downward motion of the setting portion 26, or setting tool 26, causes the setting wedge 43 to move downwardly within the well lock 40. As shown in FIG. 1, the well locking device 10 is initially located within the tubing 30 in a running mode, in which at least one locking dog 45 of the well lock 40 is permitted to remain within the well lock 40 for lowering of the well lock 40 within the tubing 30. The well lock 40 is maintained in the running mode by use of the shear ring 50 of the present invention, which is described in detail hereinafter.

In the running mode shown in FIG. 1, at least a portion of the shear ring 50 is disposed in a recess 47 formed or otherwise provided in a lower portion of the setting wedge 43, and at least a portion of the shear ring 50 is disposed within a corresponding upper recess 41 formed or otherwise provided in an upper portion of the well lock housing 44. When the setting portion 26, or setting tool 26, of the running tool 20 is forced downwardly, the shear ring 50 is sheared along a first shear plane 56 (FIGS. 3–6), as described hereinafter, thus permitting the setting wedge 43 to travel downwardly within the well lock housing 44 from a first, or running, position, thus forcing the at least one locking dog 45 outwardly from within the well lock housing 44 to engage the at least one locking dog 45 within a recess 32 formed or otherwise provided in the tubing 30.

Figure 2:
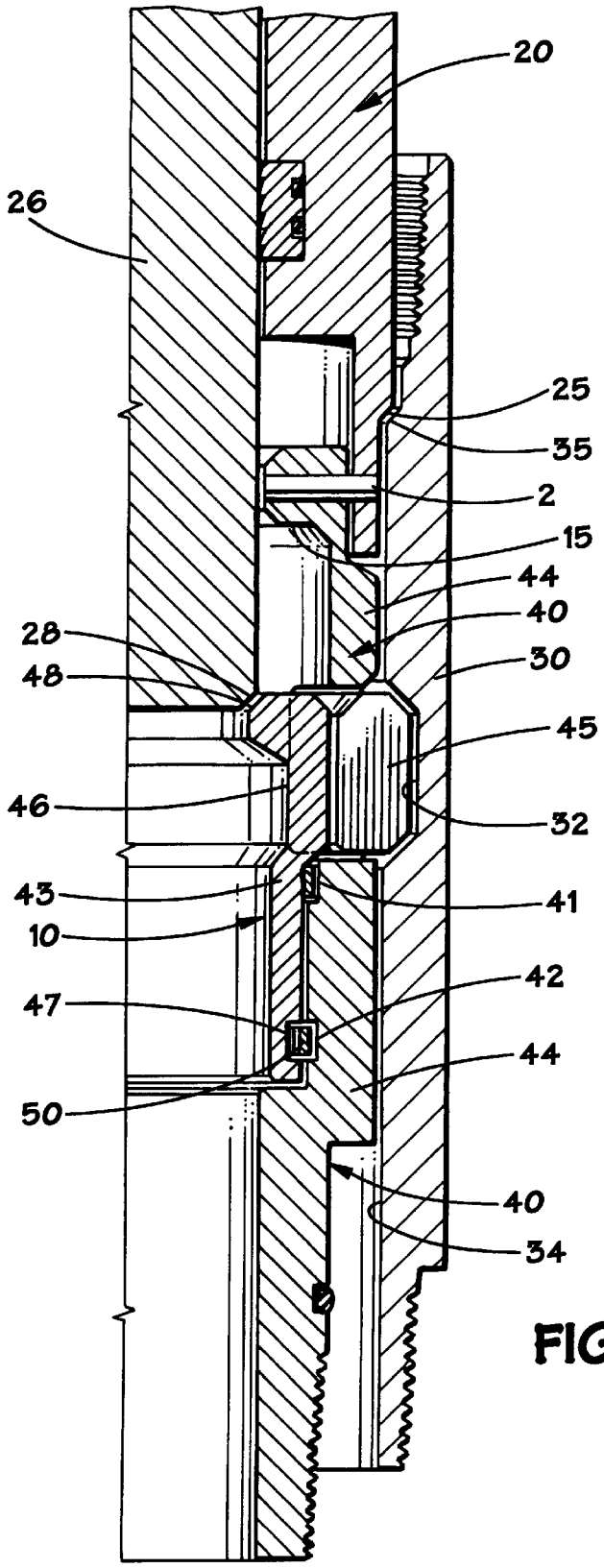
FIG. 2 is a partial elevational view, partly in cross section, illustrating the well lock of the present invention in a locking position in a landing nipple after locking.

With reference now to FIG. 2, a continued downward force applied to the setting wedge 43 by the setting portion 26, or setting tool 26, of the running tool 20 may be applied to lower the setting wedge 43 to a second, or locking, position, whereby the outwardly-biased shear ring 50, as described further hereinafter, expands so that at least a portion of shear ring 50 remains disposed within the recess 47 in the setting wedge 43 and at least a portion of the shear ring 50 is disposed within a lower recess 42 formed or otherwise provided in a lower portion of the well lock housing 44. Movement of the shear ring 50 into engagement with the lower recess 42 operates to fully engage the at least one locking dog 45 within the recess 32 of the tubing 30 and lock the setting wedge 43 in the second, or locking, position. Such locking of the setting wedge 43 in the locking position enables the well lock 40 to operate in its second, or locking, mode, thereby locking the well lock 40 and any device affixed thereto (not shown) securely within the bore 34 of the tubing 30.

After setting the well lock 40 of the present invention in its locking mode within the bore 34 of the tubing 30, the running tool 20 and its associated setting portion 26, or setting tool 26, may be detached from the well lock 40 and removed from the bore 34 of tubing 30, leaving the well lock 40 securely locked within the bore 34 of the tubing 30. In an embodiment wherein the running tool 20 and the well lock housing 44 are connected to one another by the shear pin 2, the running tool 20 may be detached from the well lock 40 by providing an upward force on the running tool 20 sufficient to shear the shear pin 2 and thereby separate the running tool 20 from the well lock 40. The upward force is resisted by the at least one locking dog 45 engaged within the recess 32 in the tubing 30. Thereafter, the running tool 20 may be easily removed from the downhole portion of the tubing 30, leaving the well lock 40 locked in place within the tubing 30.

Figure 7:
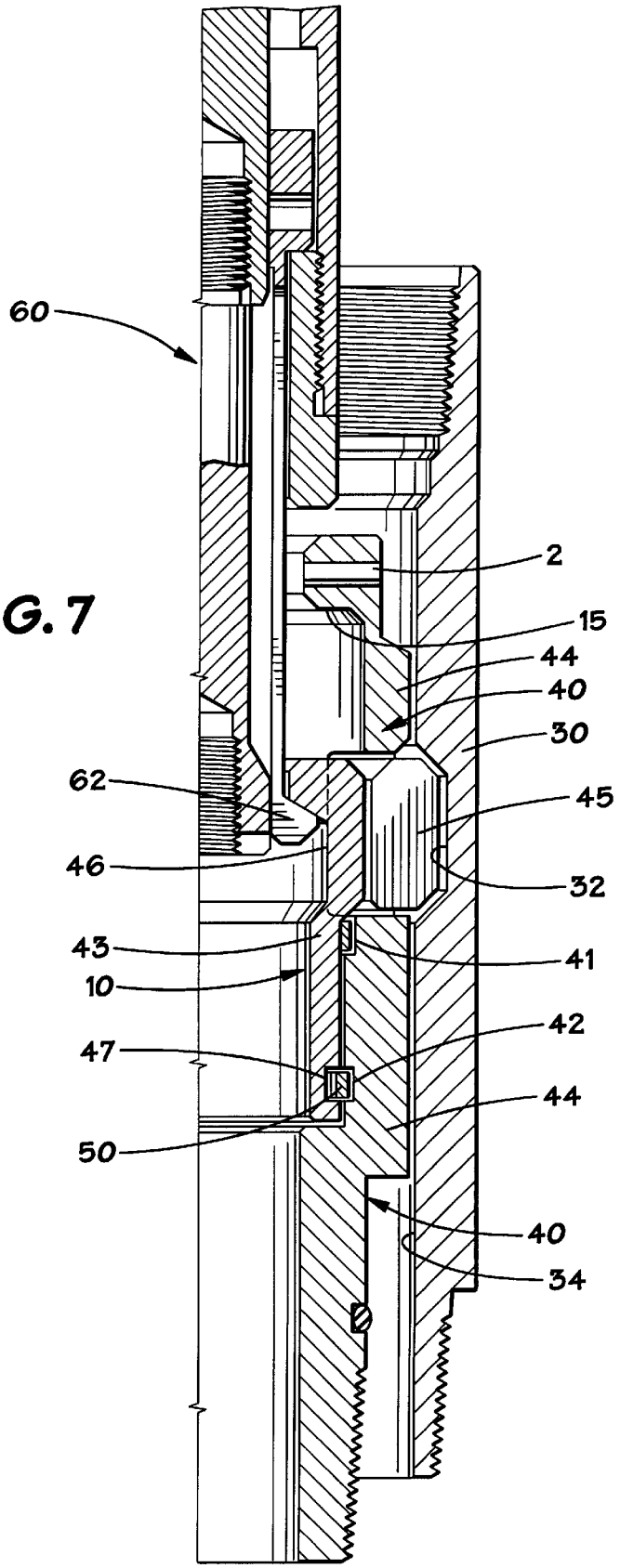
FIG. 7 is an elevational view, in cross section, illustrating the well lock of the present invention in its locking position and also showing a pulling tool engaged with an inner recess in the setting wedge.

When it is desired to remove the well lock 40 from within the bore 34 of the tubing 30, a running removal tool 60, or pulling tool 60, shown in FIG. 7, may be provided having at least one finger 62 adapted to engage the inner recess 46 formed in the setting wedge 43 of the well lock 40. The running removal tool 60 may be lowered into the downhole portion of the tubing 30 until the at least one finger 62 engages the inner recess 46 in the setting wedge 43. Thereafter, an upward force may be provided against the running removal tool 60 that is sufficient to shear the portion of the shear ring 50 engaged within the lower recess 42 of the well lock housing 44. A continued upward force may thereafter be provided against the running removal tool 60 to raise the setting wedge 43 from the second, locking, position within the well lock housing 44, returning the setting wedge 43 to the first, running, position within the well lock housing 44.

This will permit the at least one locking dog 45 to be disengaged from the tubing recess 32 and permit the well lock 40 to be removed from the bore 34 of tubing 30. When the setting wedge 43 is returned to the first, running, position within the well lock housing 44, the well lock 40 is operable in its third, or pulling, mode. A continued upward force applied to the running removal tool 60 causes the setting wedge 43 to abut a flange 15 or other portion provided on the well lock housing 44 so that continued upward movement of the setting wedge 43 will allow the well lock 40 to be removed from the tubing 30.

Figure 4:
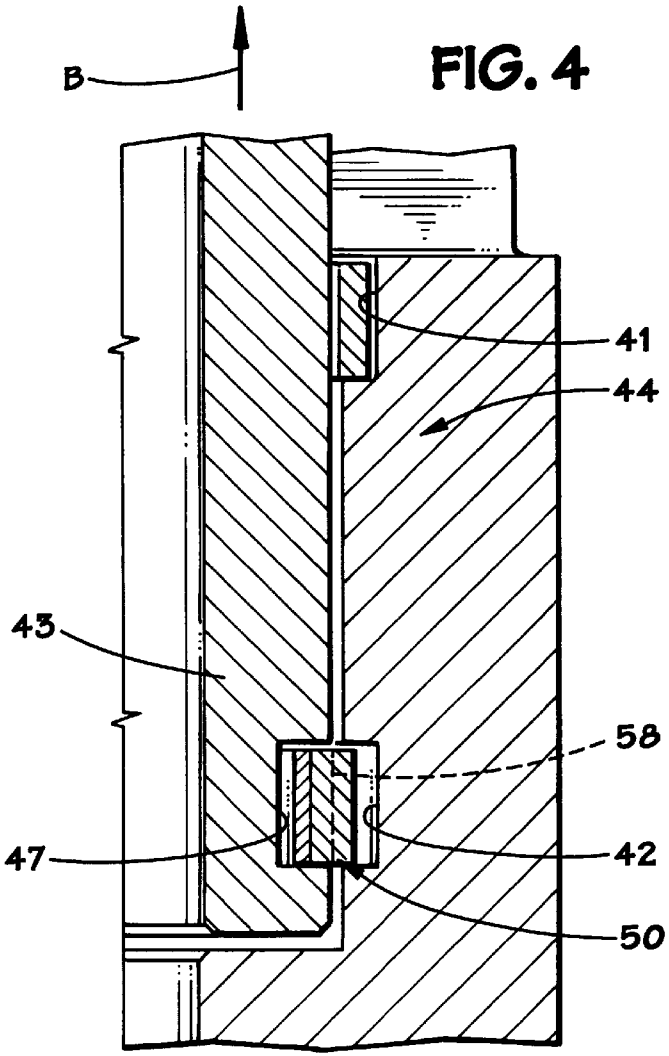
FIG. 4 is an enlarged view of the well lock of the present invention, showing an enlarged partial cross-sectional view of the setting wedge, well lock housing and double-shear shear ring of the present invention in a locking position after locking of the well lock.
Figure 3:
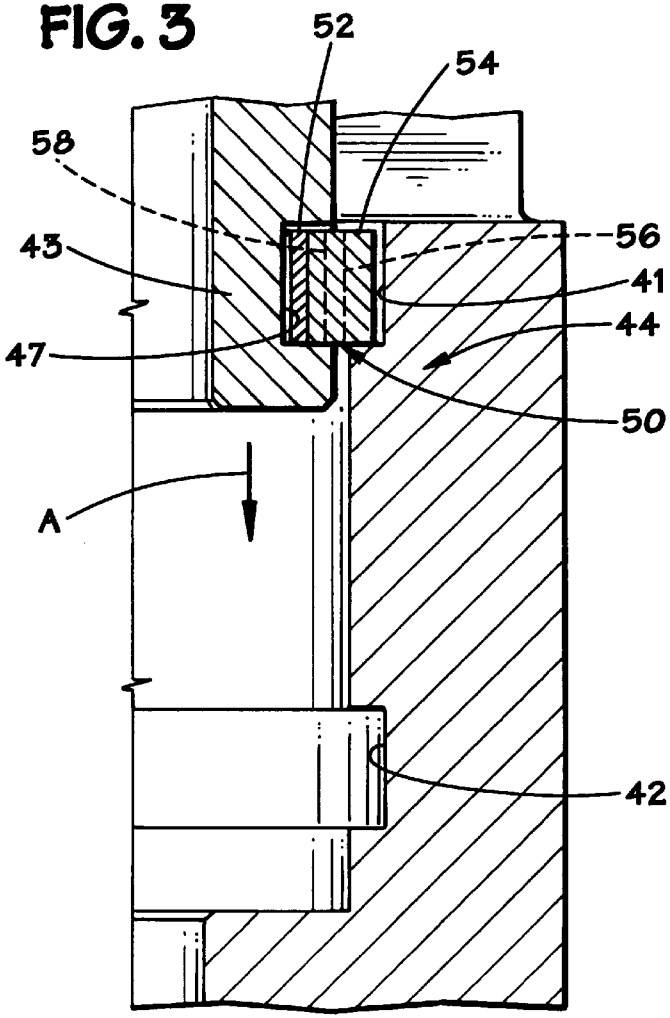
FIG. 3 is an enlarged view of the well lock of the present invention, showing an enlarged partial cross-sectional view of the setting wedge, well lock housing and double-shear shear ring of the present invention in a running position prior to locking of the well lock.

With reference now to FIGS. 3 and 4, the shear ring 50 of the well lock 40 is shown in operation to retain the well lock 40 in the running and locking modes, respectively. FIG. 3 shows at least a spring portion 52 of the double-shear shear ring 50 disposed within a recess 47 in the setting wedge 43. The remaining portion of the shear ring 50, also referred to as a shearing portion 54, is shown in FIG. 3 disposed within the first recess 41 in the well lock housing 44. FIG. 3 shows the setting wedge 43, the shear ring 50 and upper and lower portions of the well lock housing 44 in the running mode. In the running mode, the setting wedge 43, shear ring 50, and well lock housing 44 are provided in their initial, running, position. As described further above, when the setting portion 26, or setting tool 26, of running tool 20 (FIGS. 1 and 2) is moved downwardly in response to a downward force, represented by arrow A (FIG. 3), to shear the shear ring 50 and to engage locking dogs 45 (FIGS. 1 and 2) of the well lock 44 (FIGS. 1 and 2), the shear ring 50 may be sheared along the first shear plane 56 provided in the shearing portion 54 of the shear ring 50, thereby permitting the setting wedge 43 and the remaining portion of shear ring 50 disposed in the recess thereof, to travel downwardly and into engagement with the second recess 42 in the lower portion of the well lock housing 44.

FIG. 4 shows the setting wedge 43, the shear ring 50, and the upper and lower portions of the well lock housing 44 in the locking mode. When the setting wedge 43 is lowered so that the outer groove 47 formed therein is substantially aligned with the second inner groove 42 in the lower portion of well lock housing 44, the outwardly-biased spring portion 52 causes at least a portion of the shear ring 50 to be engaged within the second inner groove 42, thereby initially preventing further upward or downward movement of the setting wedge 43 within the well lock 44, thus retaining locking dogs 45 in their engaging relationship within the recess 32 of the tubing 30, as shown in FIGS. 1 and 2. The spring portion 52 of the shear ring 50 is preferably selected so that the shear ring 50 is biased towards the well lock housing 44 and so that a second shear plane 58 of the shearing portion 54 of the shear ring 50 is provided at the interface of the well lock housing 44 and the setting wedge 43.

With reference to FIG. 4, when an upward force, represented by arrow B, is imparted to the setting wedge 43 using the running removal tool 60 (see FIG. 7) upon removal of the well lock 44 in its pulling mode, the shear ring 50 will shear along the second shear plane 58 to permit upward movement of the setting wedge 43 to disengage the locking dog 45 from within the recess 32 formed in the tubing 30, thereby permitting removal of the well lock 40 from within the tubing 30, as described further above.

Figure 5:
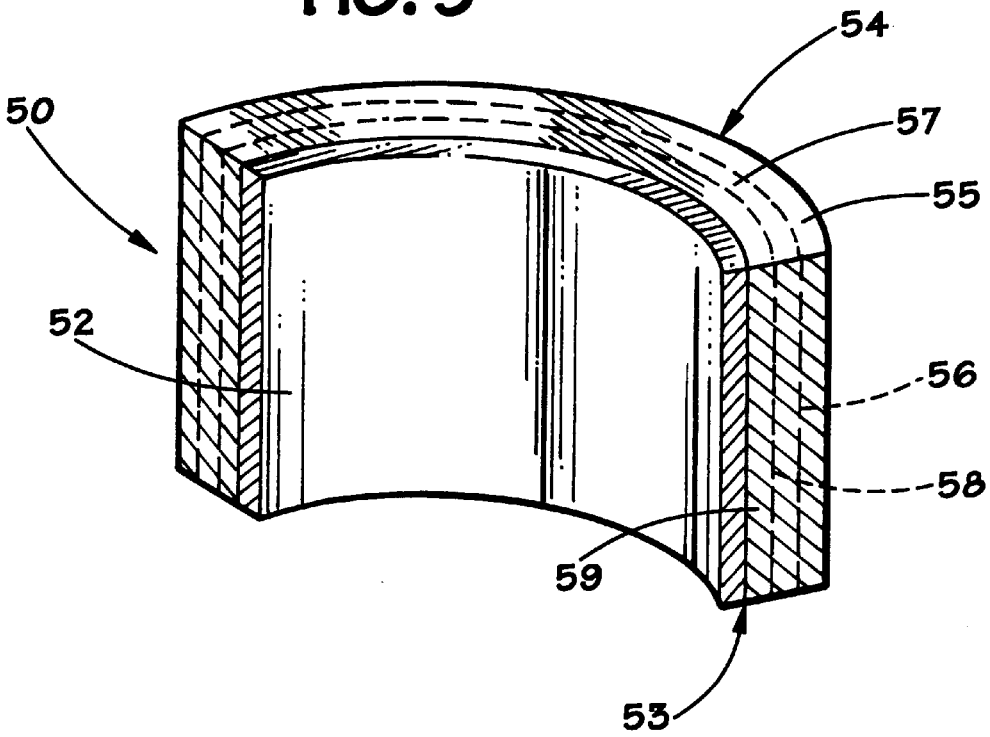
FIG. 5 is a partial, cross-sectional, perspective view of an embodiment of the double-shear shear ring of the present invention having the spring portion fused to the shearing portion.
Figure 6:
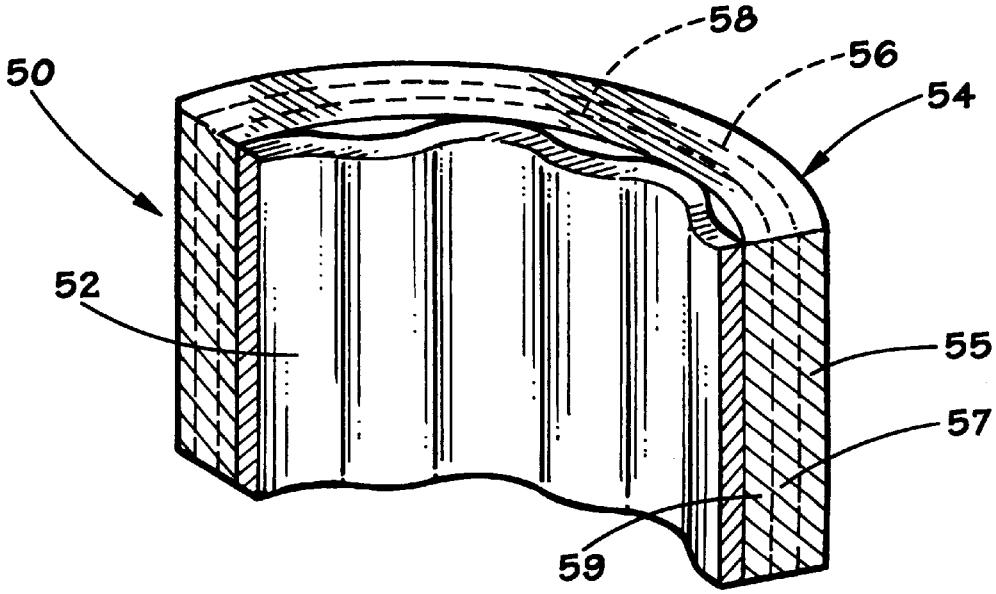
FIG. 6 is a partial, cross-sectional, perspective view of an embodiment of the double-shear shear ring of the present invention having the spring portion disposed loosely within the shearing portion.

FIGS. 5 and 6 show two embodiments of the shear ring 50 of the present invention. With reference to FIGS. 5 and 6, the shear ring 50 may comprise the spring portion 52 and the shearing portion 54, which may be fused together at a fuse location 53, as shown in FIG. 5, or the spring portion 52 may be loosely disposed adjacent the shearing portion 54, as shown in FIG. 6. The shearing portion 54 of the shear ring 50 has multiple shearable segments 55, 57 and in a preferred embodiment may have a first shearable segment 55 and a second shearable segment 57, defining a first shear plane 56 therebetween. In an embodiment of the shear ring 50 wherein the spring portion 52 is fused to the shearing portion 54, the spring portion 52 may be fused directly to the second shearable segment 57, whereby the fuse location 53 may provide a second shear plane 58. However, in a preferred embodiment, the shearing portion 54 may also include a support segment 59, which is fused to the shear ring 50. In the preferred embodiment, the support segment 59 and the second shearable segment 57 form the second shear plane 58 therebetween. It should be noted that the shearing portion 54 may be an integral piece of material, formed of brass or other shearable material. Further, the shearable segments 55, 57 and the support segment 59 may each be discrete segments, which can comprise different materials fused together, or may have deformities formed at desired locations in the shearable material to provide the discrete shear planes 56, 58. However, the shear planes 56, 58 may also be provided at whatever point along the shearing portion 54 of shear ring 50 that happens to be disposed along the interface between the setting wedge 43 and the well lock housing 44 (FIGS. 3–4) and may, therefore, not be predetermined.

The spring portion 52 of the shear ring 50 may comprise a strip of spring steel formed in a circular fashion, with the shearing portion 54 disposed loosely therearound or disposed therearound and fused thereto. The spring portion 52 of the shear ring 50 may also comprise a wave spring, as shown in FIG. 6. In the embodiments shown, the spring portion 52 is biased outwardly. However, in a particular embodiment (not shown), the spring portion 52 could be, for example, a garter spring or other spring portion, and may be disposed around the shearing portion 54 of shear ring 50 biasing the shear ring 50 inwardly towards, for example, the setting wedge 43. In such an embodiment, wherein the shear ring 50 is used in connection with the well locking device 40 of the present invention, the shear ring 50 may be disposed in a single inner groove, or recess, formed in the well lock housing 44, and the setting wedge 43 will then have first and second outer grooves, or recesses, formed therein for selective engagement of the shear ring 50 there within for retention of the setting wedge 43 in the particular modes of operation of the well locking device 10, as described further above.

FIG. 6 shows an alternative embodiment of the shear ring 50 of the present invention. With reference to FIG. 6, the spring portion 52 of the shear ring 50 is not fused to the shearing portion 54 thereof. The spring portion 52 of the shear ring 50 shown in FIG. 6 comprises a wave spring, which is shown loosely formed in a circular fashion within the shearing portion 54. In such an embodiment, the spring portion 52 should be selected such that at least a portion of the shearing portion 54, which is preferably the support segment 59, remains disposed within the outer groove 47, or recess 47, of setting wedge 43 (see FIGS. 3 and 4). While the shear ring 50 is shown for use with a well lock, it may also be used with numerous other downhole well tools (e.g., packers, etc.).

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

What is claimed is:

1. A method of setting and removing a well lock, the well lock having a setting wedge, a well lock housing, and a shear ring disposed in a recess of the setting wedge and adapted for selective engagement of the setting wedge within at least first and second recesses formed in the well lock housing, the shear ring initially engaged within the first recess of the well lock housing, including the steps of:

providing a running tool;

lowering the well lock into a downhole portion of a well tubing bore in which the well lock is to be set;

providing a first shearing force against the setting wedge to shear the shear ring along a first shear plane, to set the well lock in the tubing, and to engage the shear ring within the second recess of the well lock housing; and providing a second shearing force against the setting wedge to shear the shear ring along a second shear plane and to remove the well lock from the tubing.

2. The method of claim 1, further including providing a bearing means for preventing downward movement of the well lock beyond the downhole portion of the well tubing bore in which the well lock is to be set.

3. The method of claim 2, wherein the bearing means includes a nipple landing shoulder provided formed in the tubing.

4. The method of claim 2, wherein the bearing means further includes a no-go shoulder formed in the running tool.

5. A method of setting and removing a well lock in a bore of a tubing having a recess formed therein, the well lock having a well lock housing with a first and a second recess, at least one locking dog, a setting wedge initially disposed at a first position within the well lock housing, the setting wedge having a recess formed therein, an outwardly biased spring portion of a shear ring disposed within the setting wedge recess, and a first shearable segment of a shearing portion of the shear ring initially engaged within the first recess of the well lock housing, the method comprising:

providing a running support tool adapted to be detachably connected to the well lock housing;

detachably connecting the running support tool to the well lock housing;

lowering the running support tool with the well lock connected thereto into a downhole portion of a well tubing bore in which the well lock is to be set;

providing a running setting tool adapted to engage the setting wedge upon application of a downward force against the setting wedge;

lowering the running setting tool until it engages the setting wedge;

providing a downward force against the running setting tool sufficient to shear the first shearable segment of the shearing portion of the shear ring and to lower the setting wedge to a second position within the well lock housing, wherein the outwardly biased spring portion of the shear ring causes a second shearable segment of the shearing portion of the shear ring to be engaged within the second recess of the well lock housing and wherein the setting wedge causes the at least one locking dog to be engaged within the tubing recess;

detaching the running support tool from the well lock housing and removing the running support tool from the downhole portion of the well tubing bore;

providing a running removal tool adapted to engage the setting wedge of the well lock;

lowering the running removal tool into the downhole portion of the well tubing bore until it engages the setting wedge; and providing an upward force against the running removal tool sufficient to shear the second shearable segment of the shearing portion of the shear ring, to raise the setting wedge from the second position within the well lock housing to the first position within the well lock housing to permit the at least one locking dog to be disengaged from the tubing recess, and to remove the well lock from the downhole portion of the tubing bore.

6. The method of claim 5, further including providing a bearing means for preventing downward movement of the well lock beyond the downhole portion of the well tubing bore in which the well lock is to be set.

7. The method of claim 6, wherein the bearing means includes a nipple landing shoulder formed in the tubing.

8. The method of claim 6, wherein the bearing means further includes a no-go shoulder formed in the running support tool.

9. A method of setting a well lock, comprising:

providing a nipple landing shoulder on a tubing proximally above at least one recess in the tubing;

connecting the well lock to a running tool having a no go shoulder;

running the running tool and the well lock into the tubing;

positioning the no go shoulder into landing abutment with the nipple landing shoulder;

shearing a shear ring of the well lock allowing a setting wedge of the well lock to move relative to a well lock housing of the well lock from a running position to a locking position; and forcing at least one locking dog into the at least one recess when the setting wedge is in the locking position.

10. The method of claim 9, further comprising:

shearing the shear ring of the well lock allowing the setting wedge to move relative to the well lock housing from the locking position to a removal position; and releasing the at least one locking dog from the at least one recess when the setting wedge is in the removal position.

* * * * *